US008695506B2

(12) United States Patent
Lanclos

(10) Patent No.: US 8,695,506 B2
(45) Date of Patent: Apr. 15, 2014

(54) DEVICE FOR VERIFYING DETONATOR CONNECTION

(75) Inventor: Ronald Lanclos, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 2 days.

(21) Appl. No.: 13/365,930

(22) Filed: Feb. 3, 2012

(65) Prior Publication Data

US 2012/0199031 A1 Aug. 9, 2012

Related U.S. Application Data

(60) Provisional application No. 61/439,221, filed on Feb. 3, 2011.

(51) Int. Cl.
*F42C 21/00* (2006.01)

(52) U.S. Cl.
USPC ..... 102/206; 166/298

(58) Field of Classification Search
USPC ..... 166/298; 102/206, 202.1, 202.7, 217, 102/276; 89/1.1
See application file for complete search history.

(56) References Cited

U.S. PATENT DOCUMENTS

| | | | | |
|---|---|---|---|---|
| 4,454,814 | A | 6/1984 | Henry et al. | |
| 5,088,413 | A | 2/1992 | Huber et al. | |
| 5,347,929 | A | 9/1994 | Lerche et al. | |
| 5,505,134 | A | 4/1996 | Brooks et al. | |
| 5,971,072 | A | 10/1999 | Huber et al. | |
| 6,148,263 | A | 11/2000 | Brooks et al. | |
| 6,283,227 | B1 | 9/2001 | Lerche et al. | |
| 6,385,031 | B1 | 5/2002 | Lerche et al. | |
| 6,386,108 | B1 | 5/2002 | Brooks | |
| 6,604,584 | B2 | 8/2003 | Lerche et al. | |
| 6,752,083 | B1 | 6/2004 | Lerche et al. | |
| 6,938,689 | B2 | 9/2005 | Farrant et al. | |
| 7,007,756 | B2 | 3/2006 | Lerche et al. | |
| 7,116,542 | B2 | 10/2006 | Lerche et al. | |
| 7,336,474 | B2 | 2/2008 | Lerche et al. | |
| 7,347,278 | B2 | 3/2008 | Lerche et al. | |
| 7,383,882 | B2 | 6/2008 | Lerche et al. | |
| 7,505,244 | B2 | 3/2009 | Lerche et al. | |
| 7,520,323 | B2 | 4/2009 | Lerche et al. | |
| 7,549,373 | B2 | 6/2009 | Brooks et al. | |
| 8,091,477 | B2 | 1/2012 | Brooks et al. | |
| 2003/0070812 | A1* | 4/2003 | Robertson | 166/298 |
| 2006/0249045 | A1 | 11/2006 | Goodman et al. | |
| 2007/0125540 | A1* | 6/2007 | Gerez et al. | 166/298 |
| 2010/0133004 | A1 | 6/2010 | Burleson et al. | |

OTHER PUBLICATIONS

PCT Notification of Transmittal of the International Search Report and the Written Opinion of the International Searching Authority, or the Declaration, Dated Sep. 14, 2012, International Application No. PCT/US2012/023833.

(Continued)

*Primary Examiner* — Michelle Clement
*Assistant Examiner* — John D Cooper
(74) *Attorney, Agent, or Firm* — Bracewell & Giuliani LLP

(57) ABSTRACT

A perforating system having a perforating gun with shaped charges, a chassis sub, a communication line in communication with a controller and extending through the chassis sub and perforating gun, a selectively opened and closed continuity switch in the communication line, a lead line connecting the communication line to a detonator, and an arming switch in the lead line. A method of testing the detonator involves confirming electrical continuity through the detonator.

17 Claims, 5 Drawing Sheets

(56) References Cited

OTHER PUBLICATIONS

DYNAenergetics Perforating Panel, Multitronic III Firing Panel Type 1963, Sep. 2008.

DYNAenergetics, The DYNAenergetics—Dynawell RF-Safe Electronic Detonating System, Sep. 2008.

* cited by examiner

DEVICE FOR VERIFYING DETONATOR CONNECTION

RELATED APPLICATIONS

This application claims priority to and the benefit of copending U.S. Provisional Application Ser. No. 61/439,221, filed Feb. 3, 2011, the full disclosure of which is hereby incorporated by reference herein.

BACKGROUND OF THE INVENTION

1. Field of Invention

The invention relates generally to the field of oil and gas production. More specifically, the present invention relates to a system for use in verifying electrical continuity in a circuit for initiating ballistics subterranean. Yet more specifically, the present invention relates to a device for verifying connectivity of a detonator.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 a prior art perforating system 10 is shown disposed in a wellbore 12 and made up of a string of perforating guns 14 connected in series. Typically, subs 15 may connect adjacent guns 14 to one another. The perforating system 10 is deployed from a wireline 16 that spools from a service truck 18 shown on the surface 20. Generally, the wireline 16 provides a raising and lowering means as well as communication and control connectivity between the truck 18 and the perforating system 10. The wireline 16 is threaded through pulleys 22 supported above the wellbore 12. As is known, derricks, slips and other similar systems may be used in lieu of a surface truck for inserting and retrieving the perforating system into and from a wellbore. Moreover, perforating systems may also be disposed into a wellbore via tubing, drill pipe, slick line, coiled tubing, to mention a few.

Included with each perforating gun 14 are shaped charges 24 that typically include a housing, a liner, and a quantity of high explosive inserted between the liner and the housing. When the high explosive in a shaped charge 24 is detonated, the force of the detonation collapses the liner and ejects it from one end of the shaped charge 24 at very high velocity in a pattern called a "jet" 26. The jet 26 perforates casing 28 that lines the wellbore 12 and cement 30 and creates a perforation 32 that extends into the surrounding formation 34. The shaped charges 24 are typically connected to a detonating cord 36, which when detonated creates a compressive pressure wave along its length that initiates detonation of the shaped charges 24. A detonator 38 is typically used to set off detonation within the detonation cord 36. In FIG. 1, the detonator 38 is shown in a firing head 40 provided on an end of the string of perforating guns 14. Initiating detonation of the detonation cord 36 generally takes place by first sending an electrical signal from surface 20 to the detonator 38 via the wireline 16. The signal ignites high explosive in the detonator 38 that transfers to the attached detonation cord 36. Detonators 38 may sometimes be provided within connecting subs 15 for transferring the detonating charge along the entire string of perforating guns 14. Without proper continuity between the wireline 16 and detonator(s) 38, the shaped charges 24 cannot be detonated. Thus a reliable and convenient manner of testing electrical continuity from the surface 20 to the detonators 38 is important.

SUMMARY OF INVENTION

Disclosed herein is a system and method for conducting operations in a wellbore. In one example provided herein is a perforating system having a perforating gun with shaped charges, a communication line in the perforating gun that is in communication with a controller, a detonator in the perforating gun, and a means for measuring a flow of electricity through the detonator. Optionally, 1 the means for measuring a flow of electricity through the detonator includes an electrical meter connected in series with an electrical outlet portion of the detonator. In one example, also included is a selectively opened and closed continuity switch having an end connected to the communication line and another end connected to a lead line, where the lead line connects to the detonator. Optionally, the perforating system may further include a chassis sub on an upper end of the perforating gun and having a selectively openable and closeable arming switch in the communication line and a ground switch connected between the communication line and ground. In one example, a plurality of perforating guns may be included along with shaped charges in each of the perforating guns, and detonators in the perforating guns. In this example, the means for measuring a flow of electricity through the detonator is electrically connected to each detonator. In another example, the perforating system also includes a line connecting the communication line with the detonator, wherein the communication line is coupled with an electrical source, and wherein the means for measuring a flow of electricity through the detonator is disposed in the line.

Also provided herein is a perforating system having a string of perforating guns, shaped charges and detonating cords in the perforating guns; where the shaped charges are connected to detonating cords in the perforating guns Also included, is a communication line in the perforating gun that is in communication with a controller, a detonator in the perforating gun having an electrical inlet line and an electrical outlet line that connects between the detonator and ground, and an electrical meter connected to one of the detonators, so that when a test current flows from the communication line through one of the detonators and to ground, the electrical meter can monitor the flow of the test current. Further optionally included is a resistor in the electrical outlet line. Thus the test current flows from the detonator through the electrical outlet line and the meter connects to the electrical outlet line between the detonator and the resistor. In one example, the meter is provided in the electrical inlet line between the detonator and the communication line. A selectively opened and closed continuity switch may be included that has an end connected to the communication line and another end connected to the electrical inlet line. In one example, further included is a chassis sub on an upper end of the string that has a selectively openable and closeable arming switch in the communication line and a ground switch connected between the communication line and ground. In an alternate embodiment, an electrical source is included that is controlled by a controller and that is for providing electricity to the detonators.

A method of wellbore operations is included in this disclosure that includes providing a perforating string; where the perforating string comprising a perforating gun, a shaped charge in the perforating gun, and a detonator that is in selective electrical communication with an electrical source. The method includes inserting the perforating string into the wellbore and flowing an amount of electricity to the detonator that is below a threshold amount for initiating detonation of the detonator. The electrical flow through the detonator is monitored and electrical communication between the detonator and an electrical source is determined when an amount of electrical flow through the detonator is detected. Optionally, the method also includes perforating the wellbore by flowing an amount of electricity to the detonator that is above the threshold amount for initiating detonation of the detonator. In this example, the depth of the perforating string during testing of electrical continuity to the detonator is less than the depth at which the perforating string is when perforating the wellbore. In one example, the detonator includes an electrical outlet line and wherein testing involves measuring electrical potential at a location along the electrical outlet line. Optionally, the detonator includes an electrical inlet line and wherein testing involves measuring a flow of electricity through the electrical outlet line. In an alternate embodiment, the perforating system further includes a switch between the electrical source and the detonator. In this example the method further involves moving the switch from an open position to a closed position.

BRIEF DESCRIPTION OF DRAWINGS

Some of the features and benefits of the present invention having been stated, others will become apparent as the description proceeds when taken in conjunction with the accompanying drawings, in which.

Figure 1:
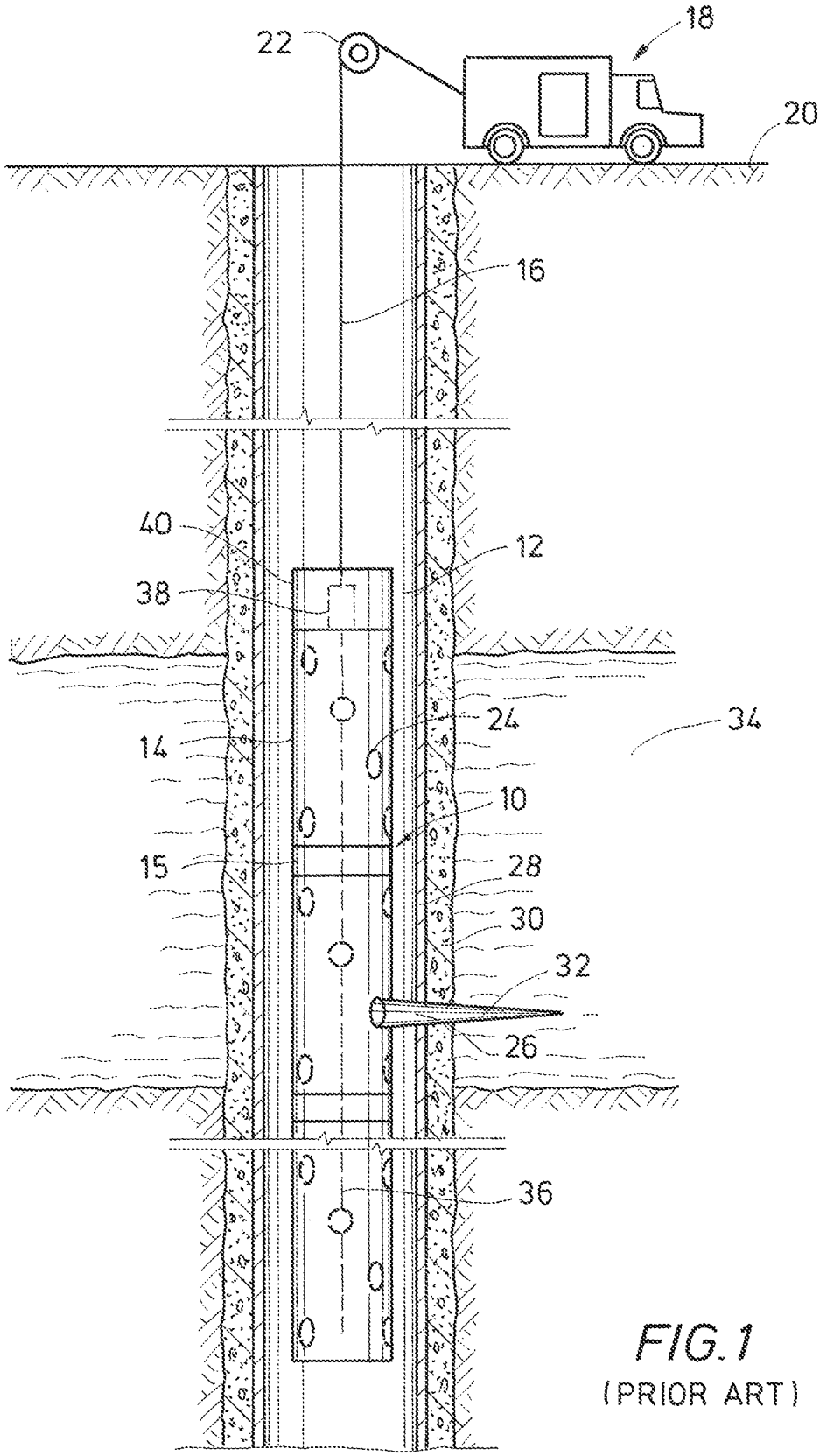
FIG. 1 (PRIOR ART)
FIG. 1 is partial cutaway side view of a prior art perforating system in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

Figure 2:
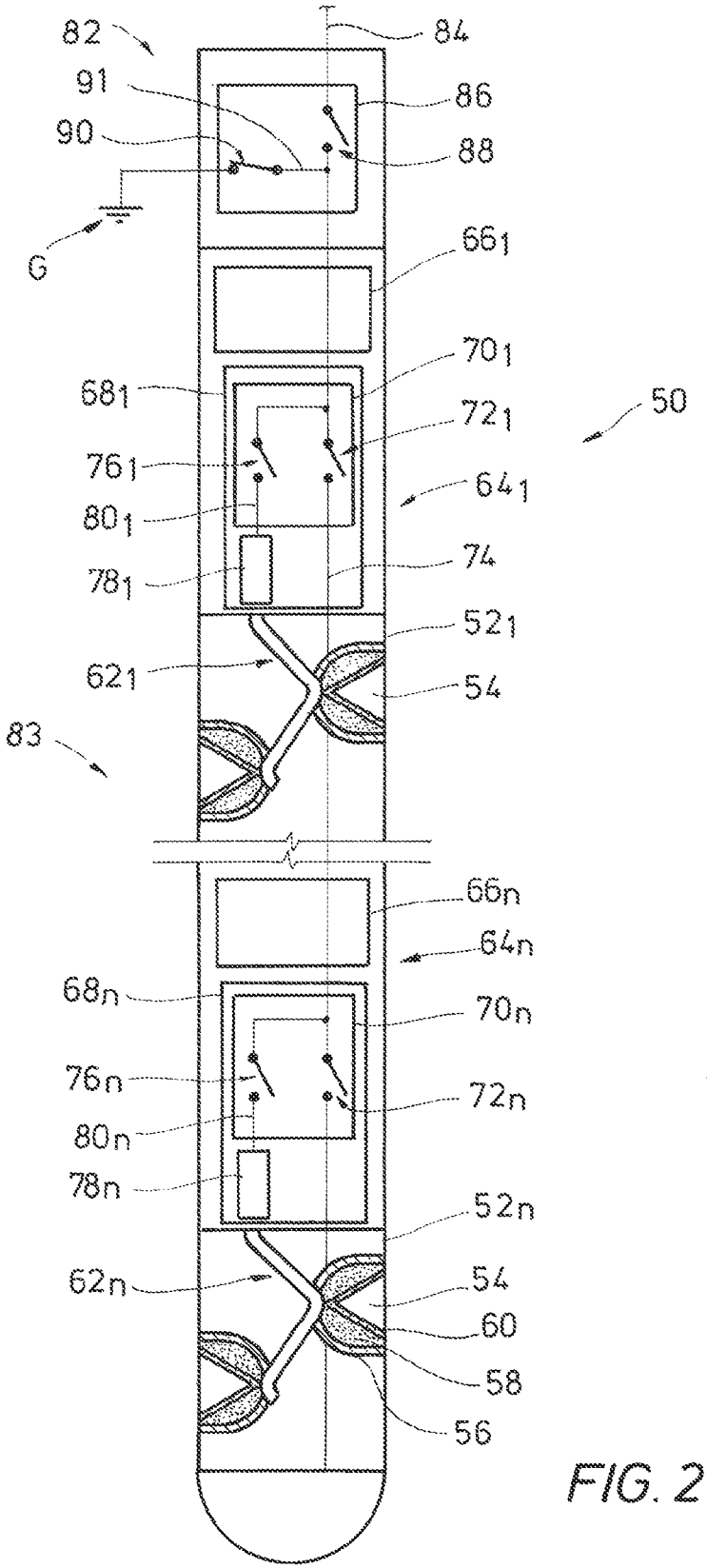
FIG. 2 is a side sectional view of an example embodiment of a portion of a perforating system in an unarmed state in accordance with the present disclosure.

Shown in a side sectional view in FIG. 2 is an example embodiment of a perforating system 50 for use in perforating a wellbore. The perforating system 50 includes perforating guns $\mathbf{52}_{1\text{-}n}$ where each of the guns $\mathbf{52}_{1\text{-}n}$ has shaped charge assemblies 54 provided therein. In the embodiment of FIG. 2 the shaped charge assemblies 54 each have an outer shaped charge case 56 partially filled with a high explosive 58 and a liner 60 sandwiching the high explosive 58 between the liner 60 and shaped charge case 56. Each of the perforating guns $\mathbf{52}_{1\text{-}n}$ include a detonating cord $\mathbf{62}_{1\text{-}n}$ for initiating detonation within each of the shaped charge assemblies 54. The detonation cords $\mathbf{62}_{1\text{-}n}$ each may be ignited by hardware within an associated chassis sub $\mathbf{64}_{1\text{-}n}$ that in the example shown are coupled in series with each of the perforating guns $\mathbf{52}_{1\text{-}n}$. Each of the chassis subs $\mathbf{64}_{1\text{-}n}$ of FIG. 2 includes a pressure bulkhead $\mathbf{66}_{1\text{-}n}$ and a chassis assembly $\mathbf{68}_{1\text{-}n}$. Included within the chassis assemblies $\mathbf{68}_{1}$, are switch assemblies $\mathbf{70}_{1\text{-}n}$, that in the example illustrated each include a continuity switch $\mathbf{72}_{1\text{-}n}$ that provides continuity through a communication line 74.

In one example embodiment, the communication line 74 extends along the length of the perforating system 50 into each of the switch assemblies $\mathbf{70}_{1\text{-}n}$. Also included within the example switch assemblies $\mathbf{70}_{1\text{-}n}$ are arming switches $\mathbf{76}_{1\text{-}n}$ for selectively providing connection to a detonator $\mathbf{78}_{1\text{-}n}$ via attached lead lines $\mathbf{80}_{1\text{-}n}$. The lead lines $\mathbf{80}_{1\text{-}n}$ are schematically depicted as projecting upward from the detonators $\mathbf{78}_{1\text{-}n}$, but because the selective nature of the switch assemblies $\mathbf{70}_{1\text{-}n}$ and arming switches $\mathbf{76}_{1\text{-}n}$; the lead lines $\mathbf{80}_{1\text{-}n}$ are out of contact with the communication line 74 in the example of FIG. 2. The detonators $\mathbf{78}_{1\text{-}n}$ of FIG. 2 are shown in a portion of each chassis sub $\mathbf{64}_{1\text{-}n}$ adjacent the associated perforating guns $\mathbf{52}_{1\text{-}n}$ and aimed toward a detonating cord $\mathbf{62}_{1\text{-}n}$ in the adjacent perforating gun $\mathbf{52}_{1\text{-}n}$. In an example, circuitry (not shown) is provided within the switch assemblies $\mathbf{70}_{1\text{-}n}$ for selectively opening and/or closing the continuity switches $\mathbf{72}_{1\text{-}n}$ and/or the arming switches $\mathbf{76}_{1\text{-}n}$ in response to a signal delivered in the communication line 74.

Still referring to FIG. 2, the perforating system 50 further includes a safety sub 82 coupled on an upper end of the uppermost chassis sub $\mathbf{64}_{1}$ and. The safety sub 82, perforating guns $\mathbf{52}_{1\text{-}n}$, and chassis subs $\mathbf{64}_{1\text{-}n}$ define a perforating string 83; where the perforating string 83 is shown connected to a wire line 84 on its upper end. In one example embodiment, the wire line 84 is used for deploying the perforating string 83 within a wellbore and for conveying signals from the surface to the perforating system 50. Optionally, tubing or slick line may be used for deploying the perforating system 50 within the wellbore. The safety sub 82 is shown having a switch assembly 86 that includes a continuity switch 88 and a ground switch 90. The continuity switch 88 is disposed in the communication line 74 so that selectively opening or closing the continuity switch 88 can either isolate or connect downstream portions of the perforating system 50 with communication to the wireline 84 and thus the surface. The ground switch 90 is disposed in a line 91 that connects the communication line 74 with ground G. Example embodiments exist where the wireline 84 is connected to ground G. Optionally, the wireline 84 can include a line, sheath, or armor (not shown) that provides a ground function. Thus, selectively opening and closing the ground switch 90 can shunt any current in the communication line 74, such as that delivered from the wire line 84, to ground to disarm the portion of the perforating system 50 downstream from where the line 91 connects to the communication line 74. Opening and closing of the continuity switch 88 and ground switch 90 can be controlled by circuitry, such as a circuit board (not shown) provided within the switch assembly 86. Optionally, the opening and closing of the switches 88, 90 can be controlled through signals delivered via the wire line 84 initiated from the surface.

Figure 3:
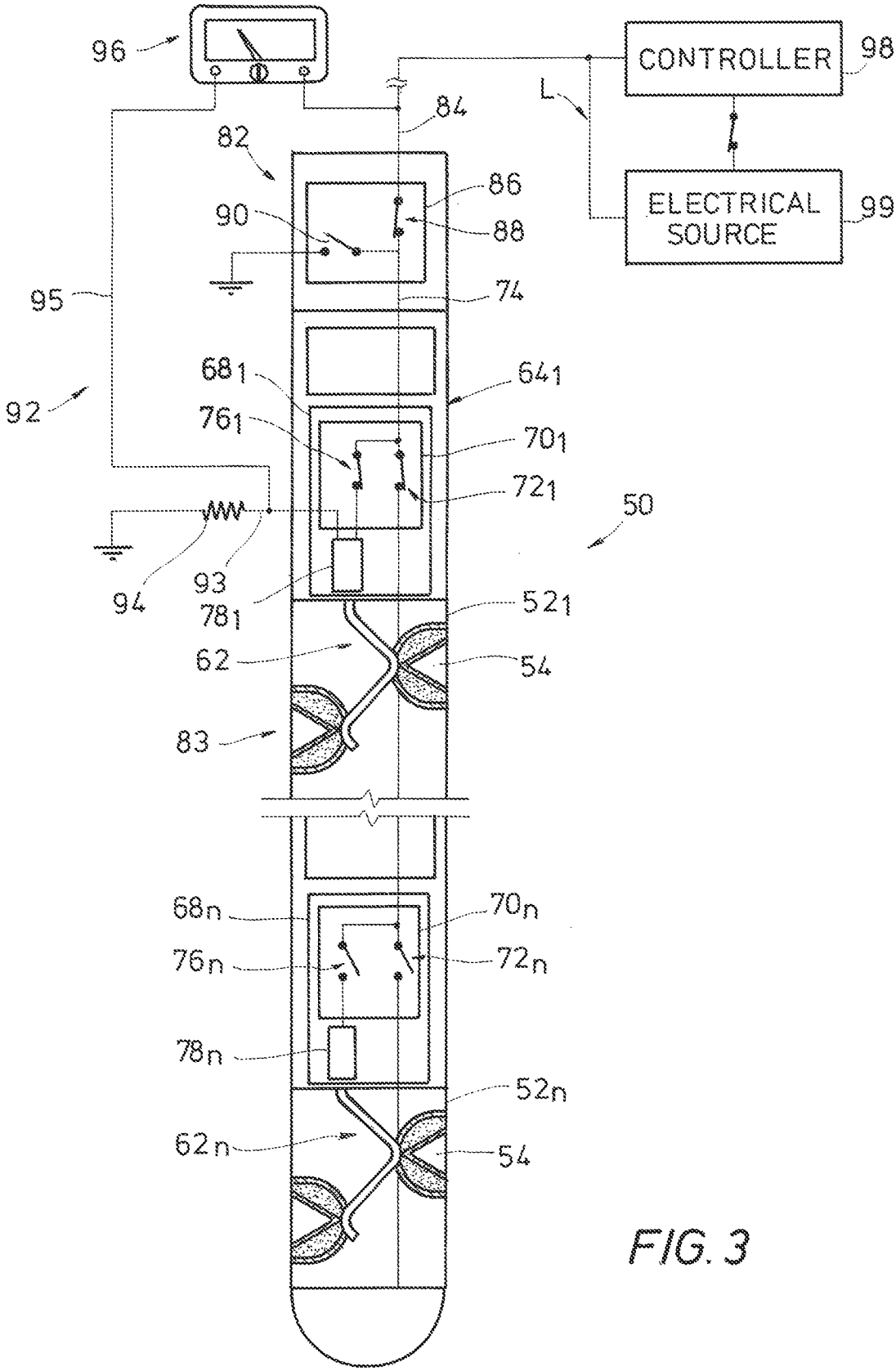
FIG. 3 is a side sectional view of the perforating system of FIG. 2 in an armed state in accordance with the present disclosure.

Referring now to FIG. 3, an example of the perforating system 50 is illustrated in one operational phase wherein the continuity switch 88 and the safety sub 82 is in a closed position and the ground switch 90 is in an open position. When this configuration, continuity is achieved from the wireline 84, through the communication line 74, and to the chassis sub $\mathbf{64}_1$. As such, any communication, signals, or current sent from the surface via the wire line 84 may reach the chassis sub $\mathbf{64}_1$. Further illustrated in the example of FIG. 3 are that the continuity switch $\mathbf{72}_1$ is in the closed position so communication through the communication line 74 is enabled to downstream of the chassis sub $\mathbf{64}_1$. Also the arming switch $\mathbf{76}_1$ is closed and in contact with the lead line $\mathbf{80}_1$, which electrically connects the detonator $\mathbf{78}_1$ to the communication line 74 so current in the communication line 74 can reach the detonator $\mathbf{78}_1$. By applying at least a threshold amount of current to the detonator $\mathbf{78}_1$ from the communication line 74, the detonator $\mathbf{78}_1$ can ignite, which initiates detonation of the perforating cord $\mathbf{62}_1$, that in turn detonates the shaped charges 54 in the perforating sub $\mathbf{52}_1$. As noted above, control of the switches $\mathbf{72}_1$, $\mathbf{76}_1$ can take place via circuitry and/or circuit boards provided in the switch assembly $\mathbf{70}_1$. Applying a threshold amount of current to ignite the detonator is within the capabilities of those skilled in the art.

Optionally, while in the configuration of FIG. 3, connection integrity leading up to the detonator $\mathbf{78}_1$ may be verified via a test circuit 92. In the example of FIG. 3, the test circuit 92 includes a discharge line 93 connected on an end to an electrical outlet portion of the detonator $\mathbf{78}_1$ and on an opposite end to a resister 94. Another line 95 is shown connected on one end to line 93 upstream of the resistor 94 and on its other end to a meter 96. Lines 93, 95 thus connect the resistor 94 and meter 96 to the detonator $\mathbf{78}_1$. In example embodiments where the detonator includes a resistor on a lead, the test circuit 92 can be made up of the meter 96 and connecting lines. As shown, the resister 94 is set in the test circuit 92 and in a line between the detonator $\mathbf{78}_1$ and meter 96. Embodiments exist where the detonator $\mathbf{78}_1$ is a resistorized detonator so that the resistor 94 is included within the detonator $\mathbf{78}_1$. Further illustrated in the example of FIG. 3 is an optional line from the meter 96 in communication with the communication line 74 via the wire line 84. Example embodiments exist where the meter 96 may be set at surface so that operations personnel can monitor connection integrity, between the communication line 74 and the detonator $\mathbf{78}_1$. In an alternative, the line between the meter 96 and wireline 84 can be replaced with a connection between the meter 96 and upstream of the resister 94.

In an example, testing connection integrity to the detonator $\mathbf{78}_1$ involves configuring the perforating system 50 as depicted in FIG. 3, i.e., closing switches 88, $\mathbf{76}_1$ and opening switch 90, and delivering a current large enough to be monitored, yet below the threshold necessary for initiating activation of the detonator $\mathbf{78}_1$. In an example of testing connectivity, a current of about 20 milliamps is applied to the communication line 74 that in turn flows through the detonator $\mathbf{78}_1$ and into the test circuit 92; current flowing into the test circuit 92 can be monitored with the meter 96, thereby confirming proper integrity of connections up to and through the detonator $\mathbf{78}_1$. In an example embodiment, current is applied to the communication line 74 from the wire line 84. Conversely, if no current is monitored at the meter 96 after emitting the test current, it can be an indication of an open circuit between the communication line 74 and detonator $\mathbf{78}_1$.

Although not shown in FIG. 3, embodiments exist where each of the detonators $\mathbf{78}_{1\text{-}n}$ has lead line $\mathbf{80}_1$ in communication with the communication line 74 and another lead in electrical communication with the test circuit 92. In this example, every detonator $\mathbf{78}_{1\text{-}n}$ can be in this configuration at the same time, a single detonator $\mathbf{78}_{1\text{-}n}$, or a selected two or more of the detonators $\mathbf{78}_{1\text{-}n}$. Thus, in one example embodiment, connectivity or continuity to each of the detonators $\mathbf{78}_{1\text{-}n}$ may be selectively checked or verified in this fashion. In an example embodiment, the testing may occur at a time when the perforating system 50 is deployed in a wellbore but before being lowered to a significant depth. For example, the testing may occur at a depth of from about 100 to 200 feet instead of thousands of feet. By identifying system defects at a depth closer to the surface and not as deep in a wellbore, time may be saved in retrieving a perforating system 50 for repair.

Although the switches $\mathbf{72}_n$, $\mathbf{76}_n$ of FIG. 3 are shown in an open position, embodiments exist wherein a signal may be delivered to the communication line 74 to the switch assembly $\mathbf{70}_n$, thereby selectively closing one or both of switches $\mathbf{72}_n$, $\mathbf{76}_n$. After closing the switches $\mathbf{72}_n$, $\mathbf{76}_n$, the detonator $\mathbf{78}_n$ can be tested, as for example as described above, or detonated for initiating the detonation cord $\mathbf{62}_n$ and the shaped charges 54 in the perforating gun $\mathbf{52}_n$.

Still referring to FIG. 3, an optional controller 98 is shown schematically provided and in connectivity with the wireline 84. The controller 98 may be located at surface or optionally disposed downhole with the perforating system 50. When at surface, the controller 98 may be included with a surface truck or other communication devices coupled to the wire line 84. In an example embodiment, the controller 98 can control an electrical source 99 for delivering electricity to the perforating string 83. As shown, the controller 98 is in signal communication with the electrical source 99, and the electrical source 99 has a output line L that connects to the wireline 84.

Figure 4:
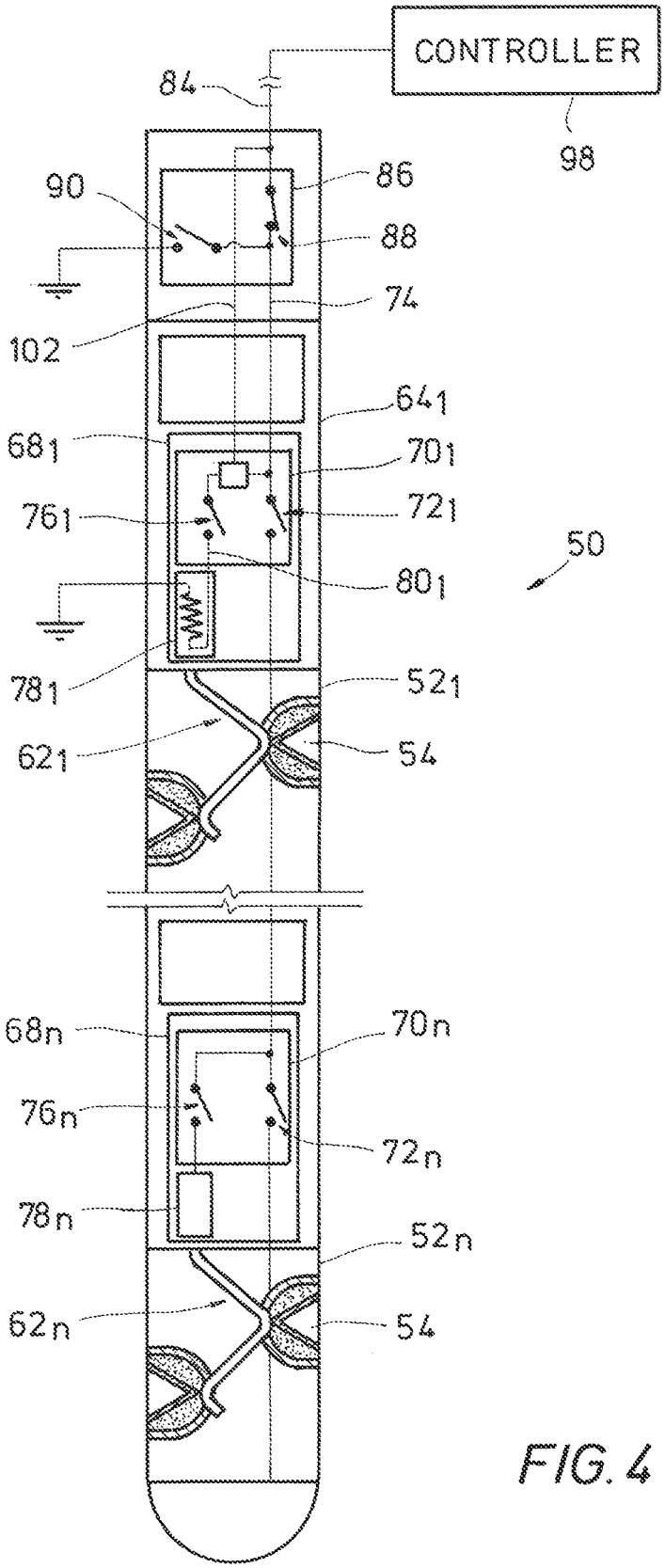
FIG. 4 is a side sectional view of an alternative embodiment of the perforating system of FIG. 2 in an armed state in accordance with the present disclosure.

Referring now to FIG. 4, an alternate embodiment of perforating system 50 is provided in a schematic view. In this example the detonator $\mathbf{78}_1$ is "resistorized" and has an internal resistor for limiting electrical flow to the detonator $\mathbf{78}_1$. Also, a meter 100 is shown in the switch assembly $\mathbf{70}_1$ for measuring electrical flow or potential to the detonator $\mathbf{78}_1$ and through the detonator $\mathbf{78}_1$. A communication line 102 is provided having an end attached to the meter 100 and an opposite end connected to the wireline 84 for providing communication between the meter 100 and controller 98. An advantage of the embodiments illustrated is continuity through a detonator or detonators is measured rather than only continuity to the detonator or detonators. An optional analog to digital converter may be included within the meter 100 or the switch assembly $\mathbf{70}_1$. The values measured with the meter 100 can be transmitted to the controller 98 via the communication line 102, which is schematically illustrated connecting the meter 100 to the wireline 84.

Figure 5:
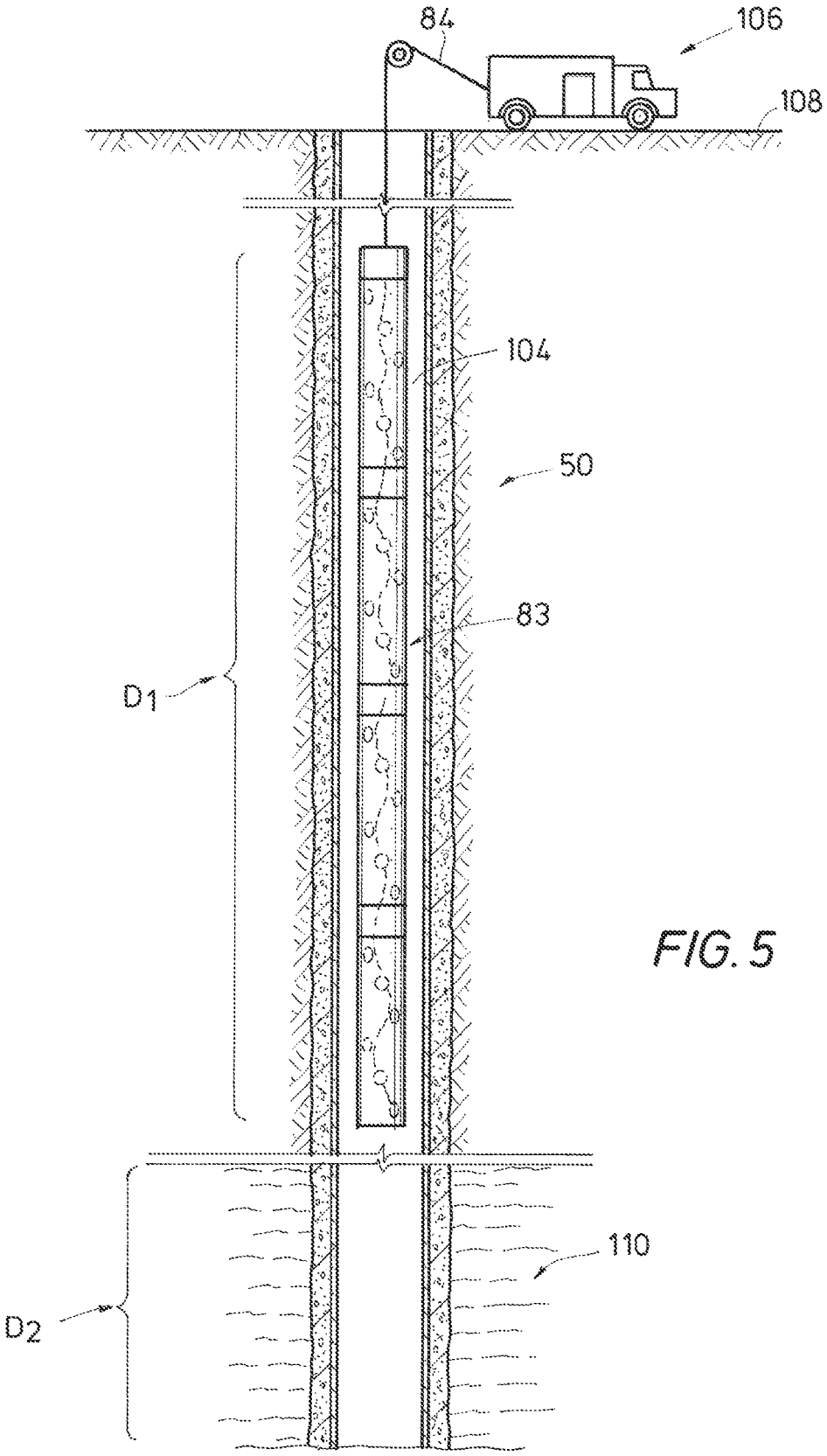
FIG. 5 is a side partial sectional view of an example of operation of the perforating system of FIG. 2.

An example of operation of an embodiment of the perforating system 50 in a wellbore 104 is shown in a partial side sectional view in FIG. 5. In this example, a surface truck 106 is included in the perforating system 50 and provided at surface 108 above an opening of the wellbore 104. The surface truck 106 of FIG. 5 is used for deploying the perforating string 83 on wireline 84. Further illustrated in the embodiment of FIG. 5 is that the perforating string 83 is disposed at a depth $D_1$, which is above a depth $D_2$ in a formation 110 where perforating operations are designated. As noted above, testing of the circuits in the perforating system 50 can take place while the perforating string 83 is suspended on wireline 84 at depth $D_1$ and prior to lowering the perforating string 83 to the depth $D_2$ for perforating the formation 110. In the example of FIG. 5, an upper end of depth D1 can be in the range of around 50 to 300 feet, can be around 100 feet, 150 feet, or 200 feet, or any value between 50 to 300 feet. Example values for an upper end of D2 can range from around 1000 feet to in excess of 10,000 feet and be any value between.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, embodiments exist wherein the switch assembly 86 is not included in the perforating system 50. Also, it should be pointed out that the measurements of electricity can measure voltage, current, or both and can be performed with an analog or digital meter. Thus advantages of the present disclosure include the ability to selectively check the status and/or operability of a specific detonator, or detonators, in a perforating gun string disposed in a wellbore. These and other similar modifications will readily suggest themselves to those skilled in the art, and are intended to be encompassed within the spirit of the present invention disclosed herein and the scope of the appended claims.

What is claimed is:

1. A perforating system comprising:

a perforating gun with shaped charges;

a communication line in the perforating gun that is in communication with a controller;

a detonator in the perforating gun;

a means for delivering a test flow of electricity through the detonator that is applied before an initiation of the detonator and below a threshold level necessary for initiating, the detonator; and a means for measuring the test flow of electricity.

2. The perforating system of claim 1, wherein the means for measuring a flow of electricity through the detonator comprises an electrical meter connected in series with an electrical outlet portion of the detonator.

3. The perforating system of claim 1, further comprising a selectively opened and closed continuity switch having an end connected to the communication line and another end connected to a lead line, where the lead line connects to the detonator.

4. The perforating system of claim 1, further comprising a chassis sub on an upper end of the perforating gun and having a selectively openable and closeable arming switch in the communication line and a ground switch connected between the communication line and ground.

5. The perforating system of claim 1, further comprising a plurality of perforating guns, shaped charges in each of the perforating guns, and detonators in the perforating guns, wherein the means for measuring a flow of electricity through the detonator is electrically connected to each detonator.

6. The perforating system of claim 1, further comprising a line connecting the communication line with the detonator, wherein the communication line is coupled with an electrical source, and wherein the means for measuring a flow of electricity through the detonator is disposed in the line.

7. A perforating system comprising:

a string of perforating guns;

shaped charges in the perforating guns and that are connected to detonating cords in the perforating guns;

a communication line in the perforating gun that is in communication with a controller;

a detonator in the perforating gun having an electrical inlet line and an electrical outlet line that connects between the detonator and ground;

a system for supplying a test current to one of the detonators; and an electrical meter connected to the one of the detonators, so that when the test current flows from the communication line through one of the detonators and to ground and prior to initiation of the one of the detonators, the electrical meter can monitor the flow of the test current.

8. The perforating system of claim 7, further comprising a resistor in the electrical outlet line, and wherein the test current flows from the detonator through the electrical outlet line and Wherein the meter connects to the electrical outlet line between the detonator and the resistor.

9. The perforating system of claim 7, where the meter connects to the electrical inlet line between the detonator and the communication line and to a line connecting between the one of the detonators and ground.

10. The perforating system of claim 7, further comprising a selectively opened and closed continuity switch having an end connected to the communication line and another end connected to the electrical inlet line.

11. The perforating system of claim 7, further comprising a chassis sub on an upper end of the string and having a selectively openable and closeable arming switch in the communication line and a ground switch connected between the communication line and ground.

12. The perforating system of claim 7, further comprising an electrical source controlled by a controller and for providing electricity to the detonators.

13. A method of wellbore operations comprising:

a. providing a perforating string comprising a perforating gun, a shaped charge in the perforating gun, a detonator that is in selective electrical communication with an electrical source, b. inserting the perforating string into the wellbore;

c. flowing an amount of electricity to the detonator that is below a threshold amount for initiating detonation of the detonator;

d. monitoring electrical flow through the detonator; and e. determining the detonator is in electrical communication with an electrical source when an amount of electrical flow through the detonator is detected.

14. The method of claim 13, further comprising (f) perforating the wellbore by flowing an amount of electricity to the detonator that is above the threshold amount for initiating detonation of the detonator, and wherein a depth at which the perforating string is in the wellbore during steps (c)-(e) is less than a depth at which the perforating string is in the wellbore during step (f).

15. The method of claim 13, wherein the detonator comprises an electrical outlet line and wherein step (d) comprises measuring electrical potential at a location along the electrical outlet line.

16. The method of claim 13, wherein the detonator comprises an electrical inlet line and wherein step (d) comprises measuring a flow of electricity through the electrical outlet line.

17. The method of claim 13, wherein the perforating system further comprises a switch between the electrical source and the detonator, the method further comprising moving the switch from an open position to a dosed position.

* * * * *